US012384640B2

(12) United States Patent
Heroux

(10) Patent No.: US 12,384,640 B2
(45) Date of Patent: Aug. 12, 2025

(54) SINGLE WEB AUTOMATIC SPLICING UNWIND MACHINE AND METHOD

(71) Applicant: Paper Converting Machine Company, Green Bay, WI (US)

(72) Inventor: Jamie Heroux, Gillett, WI (US)

(73) Assignee: BW CONVERTING, INC., Green Bay, WI (US)

( * ) Notice: Subject to any disclaimer, the term of this patent is extended or adjusted under 35 U.S.C. 154(b) by 193 days.

(21) Appl. No.: 18/223,602

(22) Filed: Jul. 19, 2023

(65) Prior Publication Data

US 2024/0059519 A1 Feb. 22, 2024

Related U.S. Application Data

(60) Provisional application No. 63/398,699, filed on Aug. 17, 2022.

(51) Int. Cl.
*B65H 19/12* (2006.01)
*B65H 19/18* (2006.01)

(52) U.S. Cl.
CPC ... *B65H 19/18* (2013.01); *B65H 2301/46024* (2013.01); *B65H 2403/725* (2013.01)

(58) Field of Classification Search
CPC ..... B65H 19/12; B65H 19/18; B65H 23/005; B65H 23/044; B65H 23/182; B65H 23/08
See application file for complete search history.

(56) References Cited

U.S. PATENT DOCUMENTS

| | | | | |
|---|---|---|---|---|
| 4,116,399 | A * | 9/1978 | Mosburger | B65H 23/005 242/552 |
| 4,328,655 | A | 5/1982 | Spencer et al. | |
| 6,533,212 | B1 | 3/2003 | Tafel, II | |
| 10,005,636 | B2 * | 6/2018 | López | B65H 19/12 |
| 10,654,677 | B2 * | 5/2020 | Lucas | B65H 18/021 |
| 2004/0118964 | A1 | 6/2004 | Long | |

FOREIGN PATENT DOCUMENTS

| | | | |
|---|---|---|---|
| DE | 102012013459 | A1 | 1/2014 |
| EP | 1129971 | A2 | 9/2001 |

* cited by examiner

*Primary Examiner* — Sang K Kim
(74) *Attorney, Agent, or Firm* — Thompson Coburn LLP

(57) ABSTRACT

A converting line has a unwind machine with a load station assembly and a vertical movement assembly. The load station assembly rotatably supports a roll as the web is unwound during a first portion of an unwind cycle. The vertical movement assembly rotatably supports the roll during movement between lowered and raised positions during a second portion of the unwind cycle. A lower brake assembly controls rotation of the roll in the load station assembly, and an upper brake assembly controls rotation of the roll with the roll in the vertical movement assembly. With the roll rotatably supported in the load station assembly, the converting line control generates signals for the lower brake assembly to control an unwind rotation rate of the roll. With the roll rotatably supported by the vertical movement assembly, the control generates signals for the upper brake assembly to control the unwind rotation rate.

27 Claims, 9 Drawing Sheets

SINGLE WEB AUTOMATIC SPLICING UNWIND MACHINE AND METHOD

RELATED APPLICATION DATA

This application claims priority benefit of U.S. provisional application Ser. No. 63/398,699, filed Aug. 17, 2022, the disclosure of which is incorporated by reference herein.

BACKGROUND

The disclosure is directed to a control system for an unwind machine used in connection with a converting line. In particular, the unwind machine is used in a converting line where a plurality of webs are unwound and arranged in an overlapping format to form a ribbon of webs that are arranged in a vertically stacked arrangement. The overlapping format may include any number of formats of folding, including C-folding, V-folding, W-folding and Z-Folding. The plurality of webs are drawn from the unwind machine and through the fold station and to the cutting and stacking station. This disclosure addresses the operations associated with a single station of the unwind machine that allows one web in the plurality of webs to be drawn into the converting line. It should be appreciated that the principles discussed herein may be utilized on an unwind machine with multiple stations for each of the webs in the plurality of webs to be drawn into the converting line. Also, it should be appreciated that the principles discussed herein may be utilized on an unwind machine with a single web to be drawn into the converting line.

FIGS. 6-10 show embodiments of conventional unwind machines—one embodiment C1 with a pivot arm assembly having a manually adjusted drag brake DB1 to control roll rotation during unwinding, and another embodiment C2 with a pivot arm assembly having a similar manual adjusted drag brake DB2 and a splicing mechanism SM. The disclosure herein improves upon the manually adjusted drag brake shown in FIGS. 6-10 and provides brake assemblies on a vertical movement assembly and a load station that interface with a control to provide enhanced control features for the converting line.

DETAILED DESCRIPTION

Figure 1:
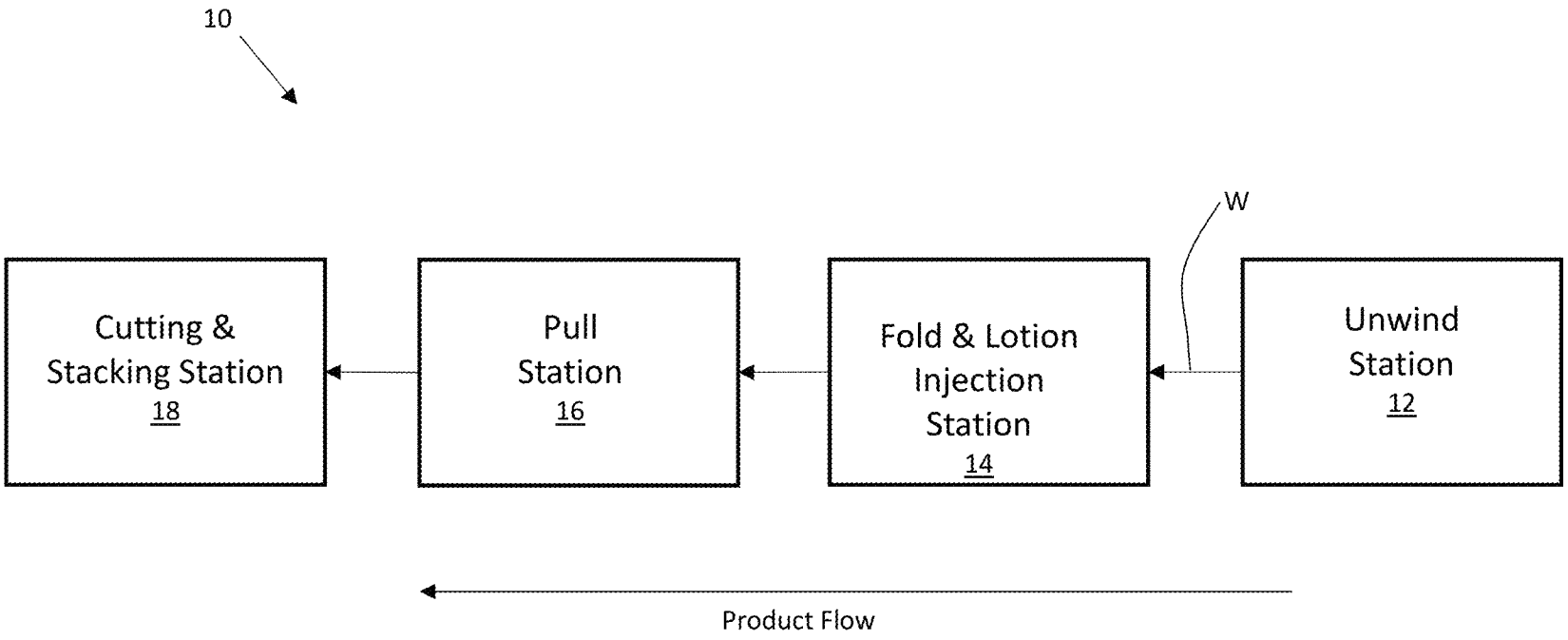
FIG. 1 is a schematic block diagram of an exemplary converting line.
Figure 2:
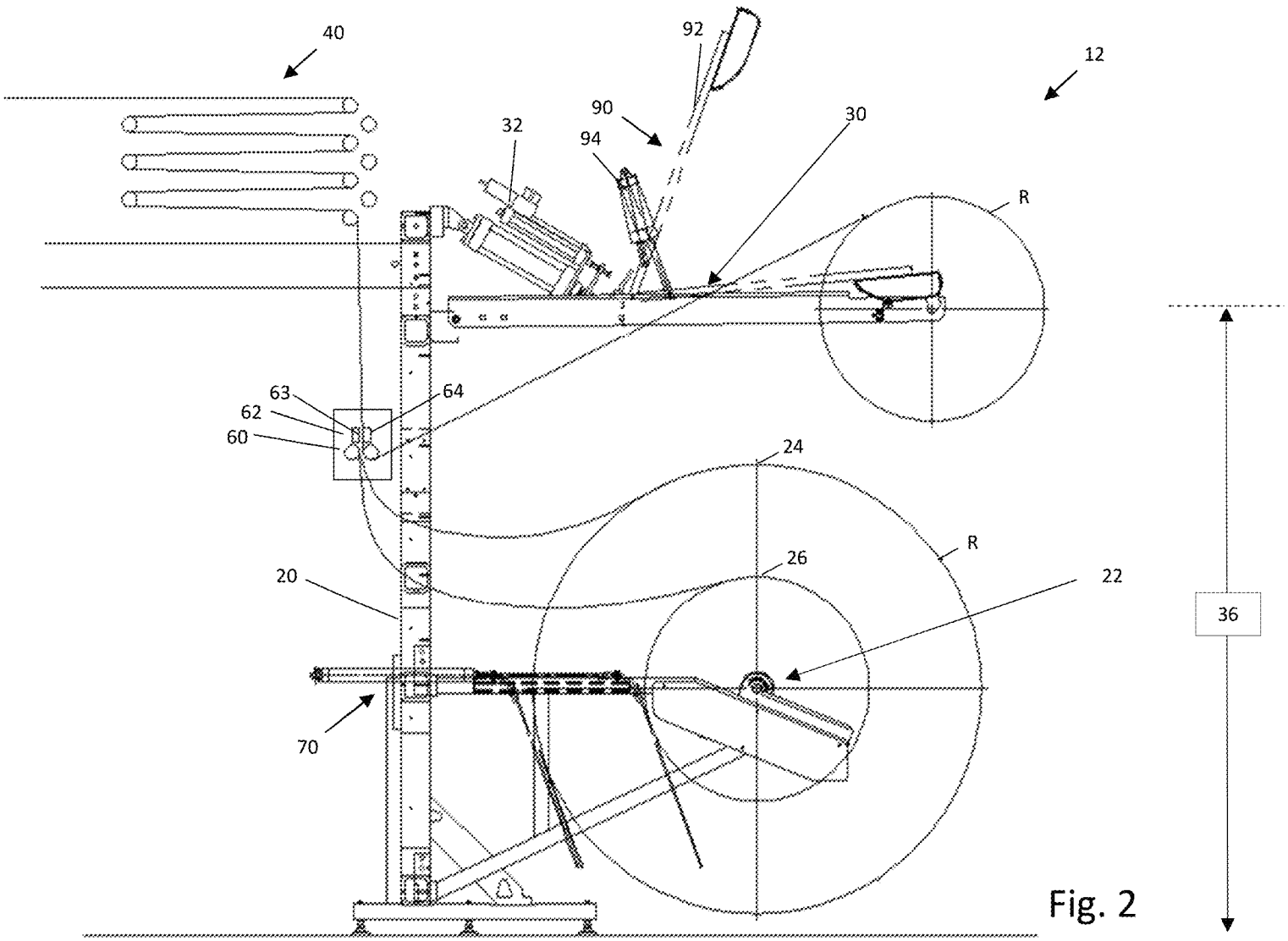
FIG. 2 shows a schematic diagram of the unwind machine showing the relative position and diameter of a roll of web material during the unwind cycle.

The unwind machine 12 is adapted and configured to deliver a web of material from a roll to downstream equipment in the converting line 10. The downstream equipment may include a folding station 14, a pull station 16, and a cutting and stacking station 18, depending upon the product format. The downstream equipment may include a rewinder and log saw, for instance, in a roll product format. The unwind machine 12 generally has a stand 20 with structural members for supporting components of the unwind machine. A load station assembly 22 is provided generally at the bottom of the stand 20. The load station assembly 22 is operatively coupled to the stand 20 and is adapted and configured to receive a roll R of the web material, for instance, at the beginning of the process to unwind the web from the unwind machine 12. The load station assembly 22 is configured to allow the operator to load a new or fresh roll R of web material into the converting line and begin a first part of the unwind cycle where the web of material is delivered to the converting line as the roll is rotatably supported in the load station assembly. The roll R may unwind from the load station assembly 22 from a first diameter configuration as shown as position 24 in FIG. 2 to a second diameter configuration as shown as position 26 in FIG. 2. Although the drawings show one load station assembly 22, multiple load station assemblies may be provided on the stand of the unwind machine 12.

Figure 3:
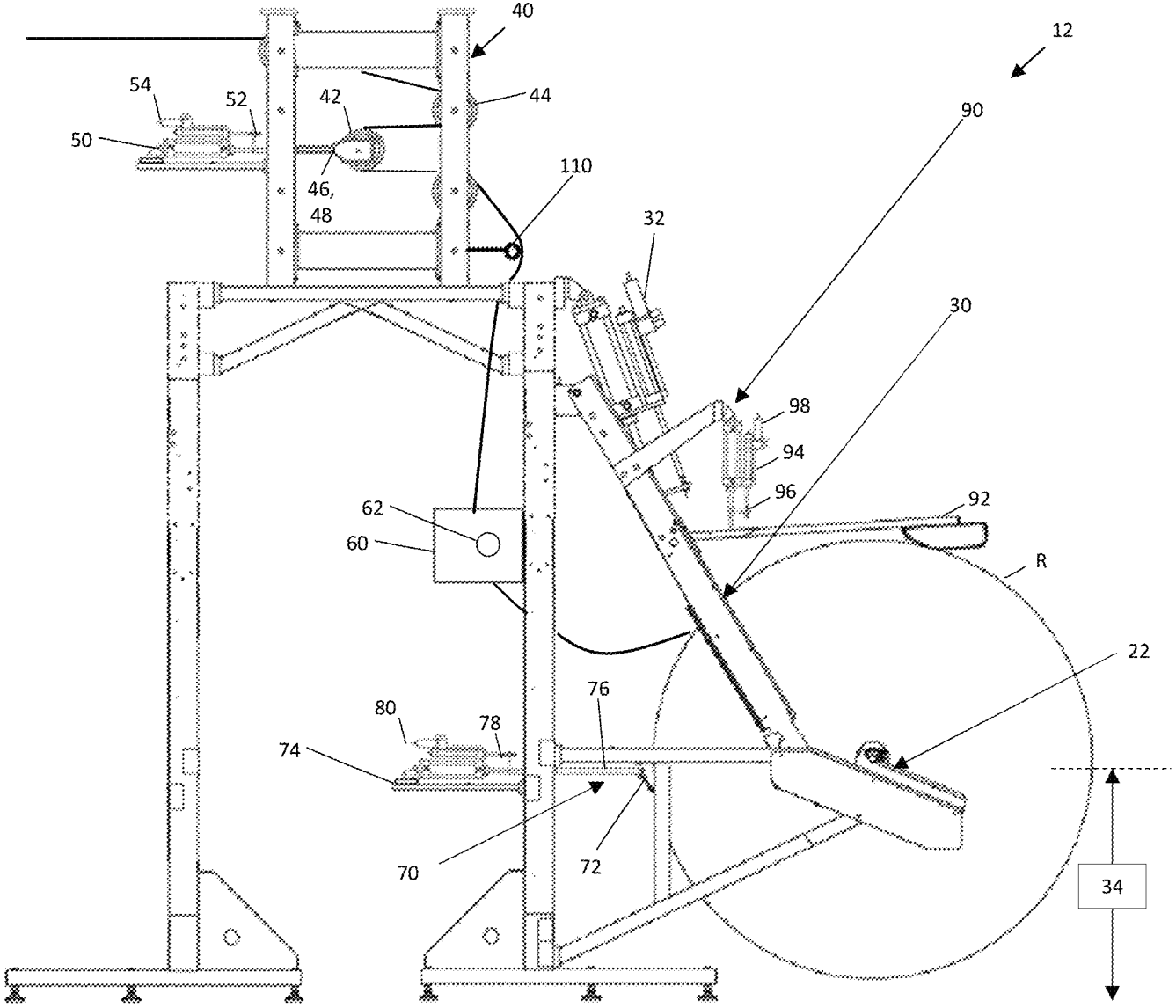
FIG. 3 is a side elevation of the unwind machine showing the roll in a load station assembly with a lower brake arm in engagement with the roll, a pivot arm assembly in position to receive the roll from the load station assembly, and an upper brake arm in engagement with the roll.
Figure 4:
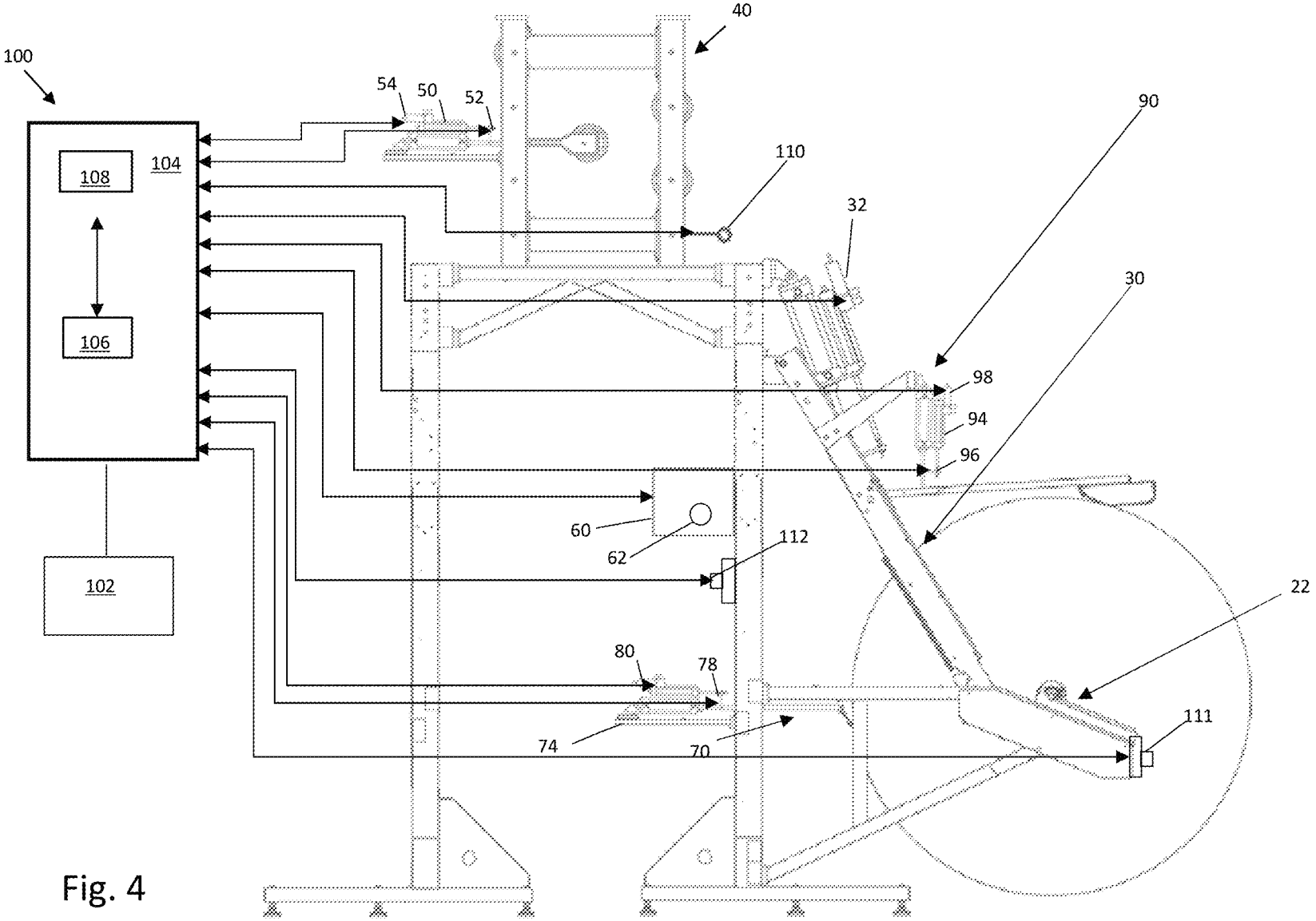
FIG. 4 shows a schematic diagram of a control of the converting line.
Figure 5A:
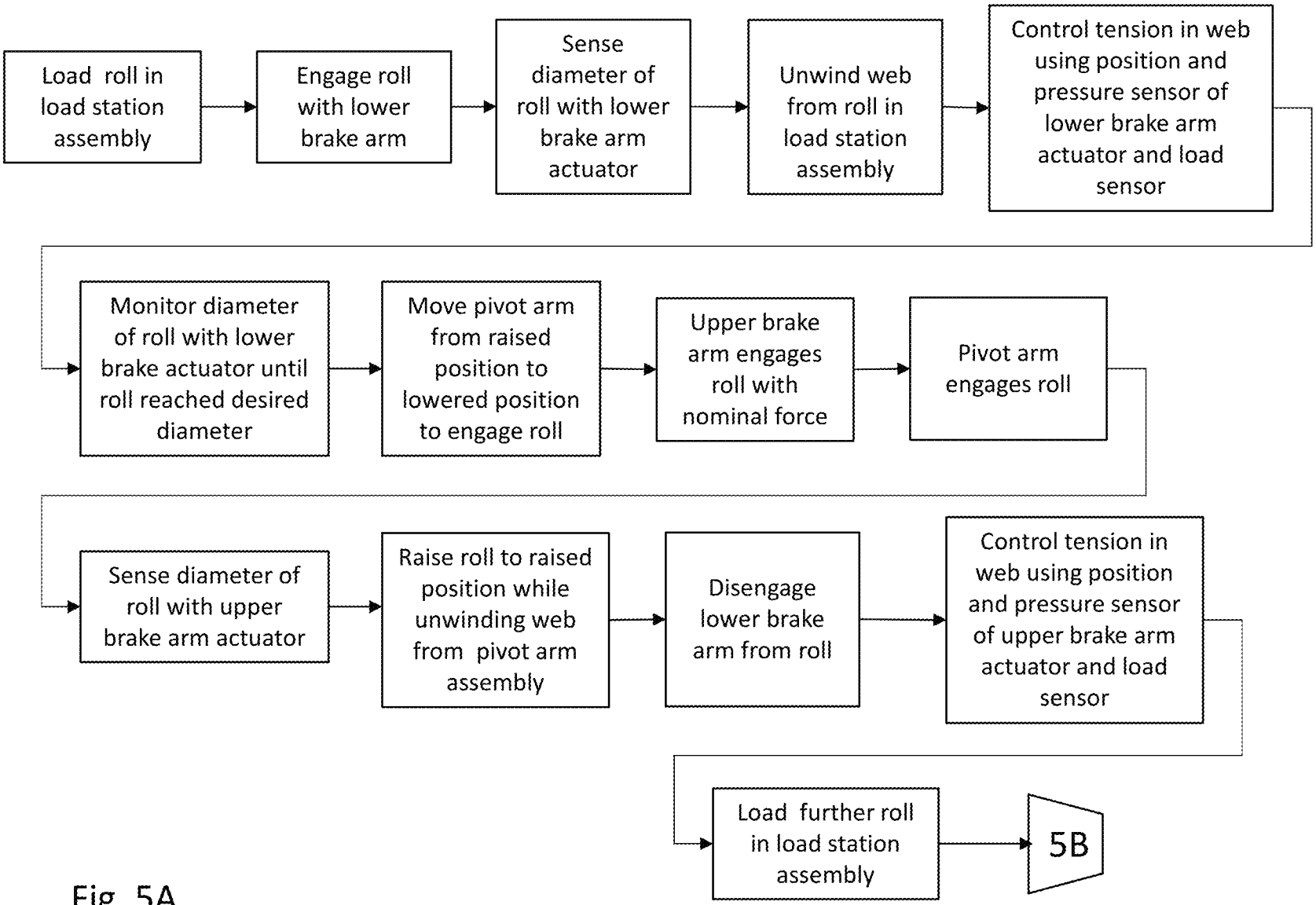
FIG. 5A is a first portion of a process flow diagram showing an aspect of operation of the converting line.
Figure 5B:
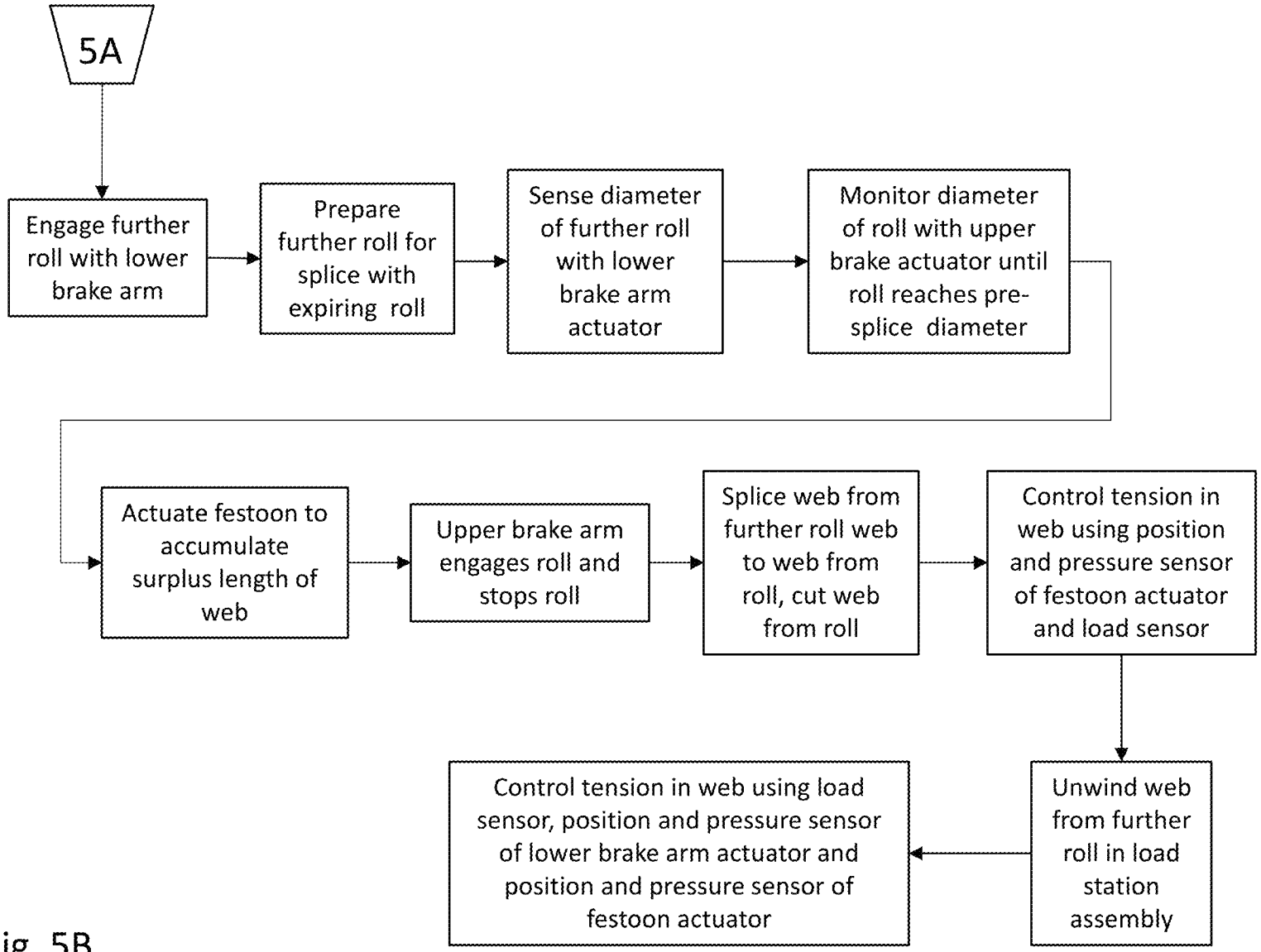
FIG. 5B is a continuation of the process flow diagram of FIG. 5A.
Figure 6:
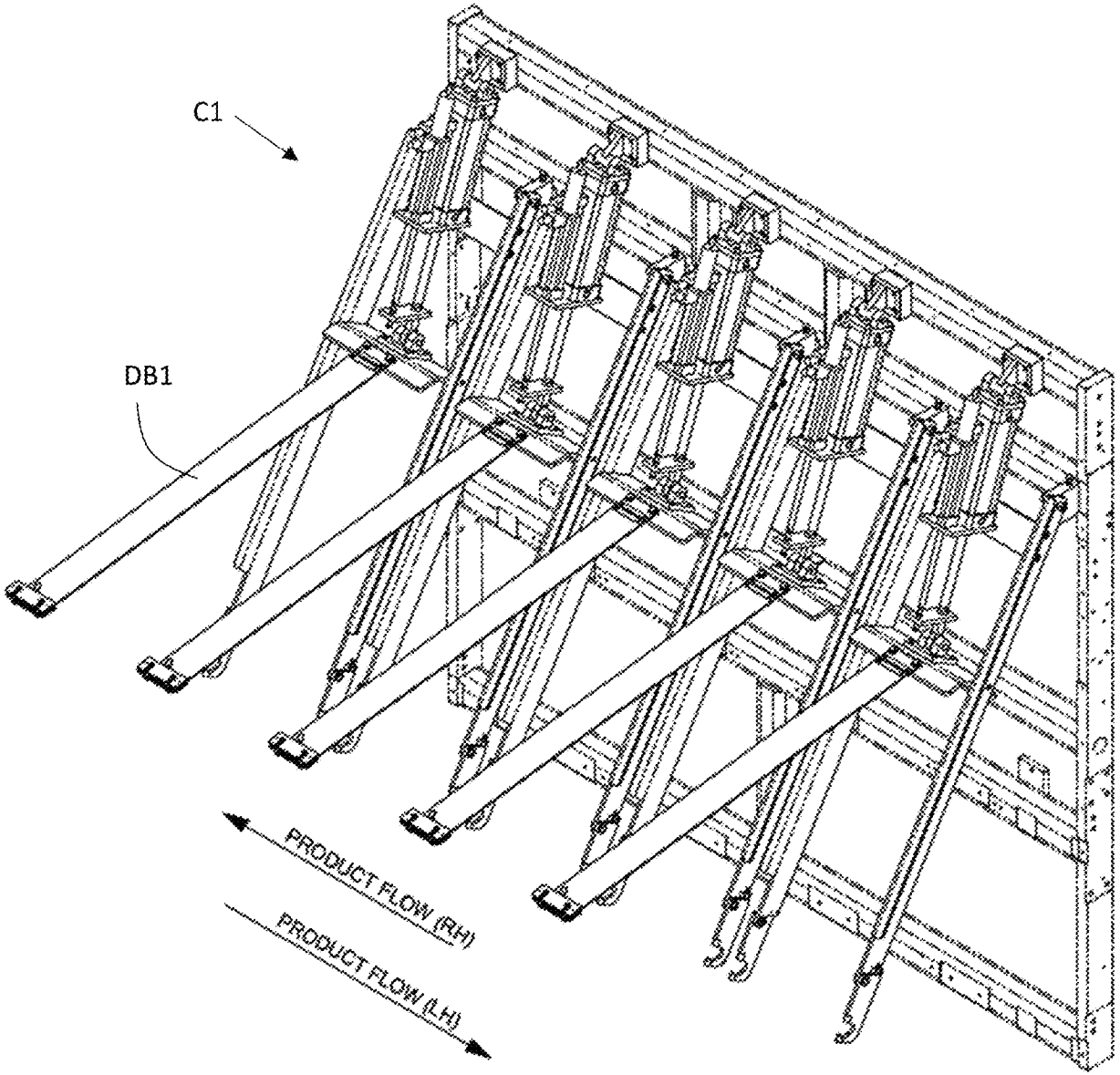
FIG. 6 shows a conventional unwind machine with a pivot arm assembly having a roll brake.
Figure 7:
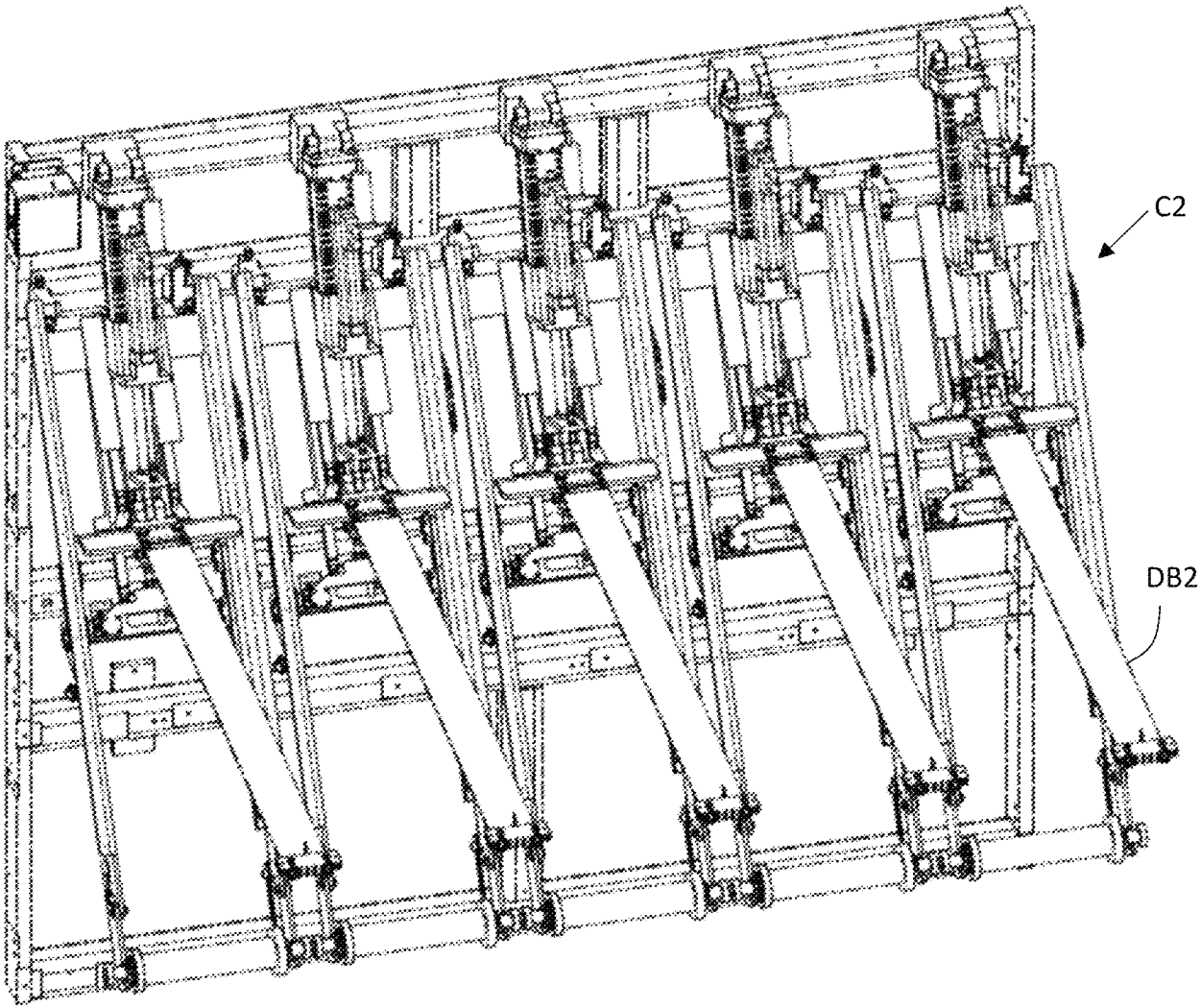
FIG. 7 shows another embodiment of a conventional unwind machine with a pivot arm assembly having a roll brake and a splicing mechanism.
Figure 8:
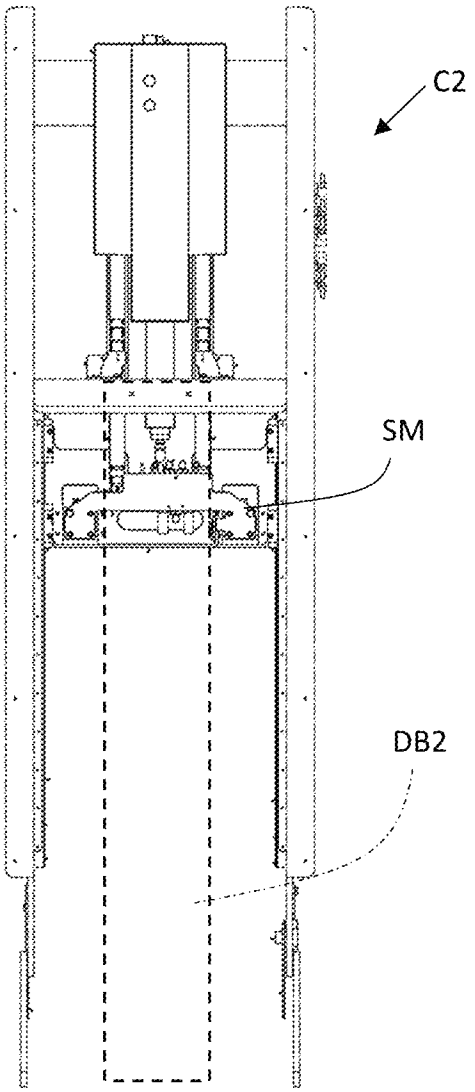
FIG. 8 is a front view of a single pivot arm assembly of the conventional unwind machine of FIG. 7 with a drag brake shown in phantom.
Figure 9:
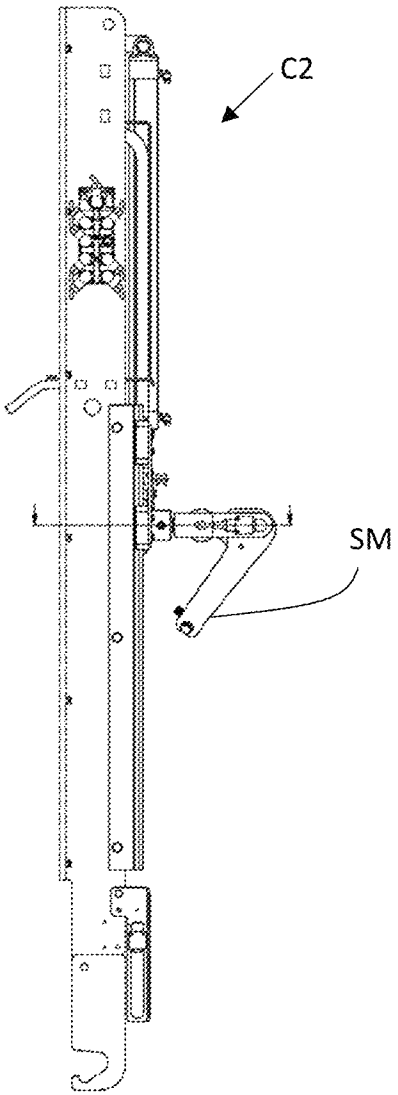
FIG. 9 is a right side view of the pivot arm assembly of FIG. 8.
Figure 10:
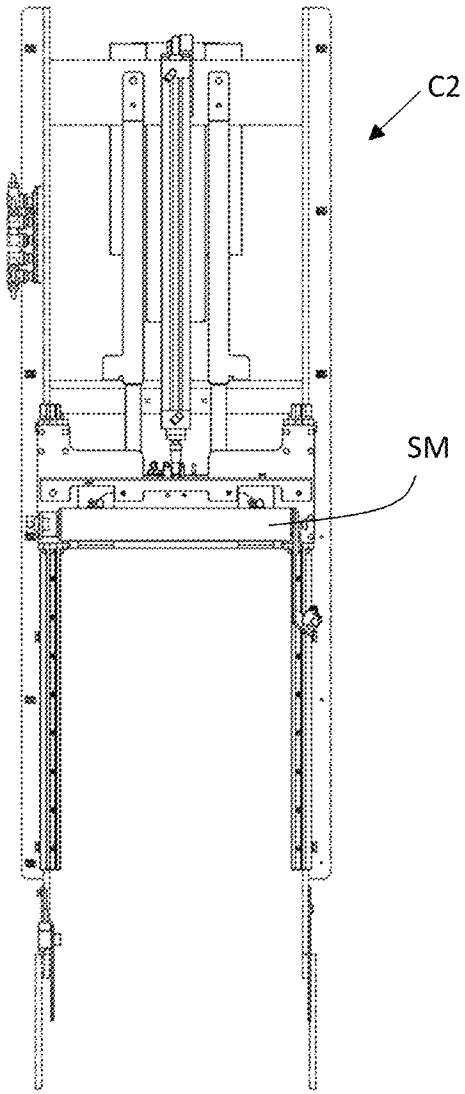
FIG. 10 is a rear view of the pivot arm assembly of FIG. 8.

The unwind machine 12 has a pivot arm assembly 30 operatively coupled to the stand 20. The pivot arm assembly 30 is adapted and configured to receive the roll R from the load station assembly 22 and move the roll vertically upward relative to the stand 20 so as to create sufficient room in the unwind machine 12 that allows the operator the ability to load a new or further roll of material in the load station assembly in queue for processing (e.g., to be spliced from the existing roll and joined to a new roll) when the existing roll is sufficiently depleted. To effectuate movement of the pivot arm assembly 30, the pivot arm assembly includes a pivot arm actuator 32. A stationary end of the pivot arm actuator 32 is operatively mounted to the stand 20 and an actuation end of the pivot arm actuator is operatively mounted to the pivot arm assembly 30. The pivot arm actuator 32 is configured to move the pivot arm assembly 30 between a lowered position 34 adjacent the load station assembly 22 (see, e.g., FIG. 3) and a raised position 36 away from the load station assembly (see, e.g. FIG. 2). The pivot arm assembly 30 is configured to rotatably support the roll R as the pivot arm assembly moves the roll between the lowered position 34 and the raised position 36 as the web material is unwound from the unwind machine 12 during a second portion of the unwind cycle. Generally, while the roll R in the load station assembly 22 is unwinding to the second diameter configuration 26, the pivot arm assembly may move to the lowered position 34 and receive the roll from the load station assembly. Then the pivot arm assembly 30 may raise the roll to the raised position 36 while continuing to allow the web to be unwound from the roll R during the second portion of the unwind cycle. Although the drawings shown one pivot arm assembly 30, multiple pivot arm assemblies may be provided on the stand of the unwind machine 12. Additionally, although the drawings and description that follows describe a pivoting or hinged arm for moving the roll between the lowered position 34 and the raised position 36, the roll may be moved with an assembly configured for providing vertical linear motion or vertical compound motion.

A festoon assembly 40 may be provided downstream of the unwind machine prior to the folding station to accumulate a length of web to facilitate joining and splicing of the web from one roll to another roll. The festoon assembly 40 may comprise at least one moveable roller 42 and at least one fixed roller 44. The at least one moveable roller 42 may be supported by a carriage 46 that is operatively slidingly connected to a rail assembly 48 of the festoon assembly 40. A festoon actuator 50 may have a stationary end operatively mounted to a structure of the festoon assembly and an actuation end operatively connected to the carriage 46 and rail assembly 48 supporting the at least one moveable roller 42. The at least one moveable roller 42 may be adapted and configured to move toward and away from the at least one fixed roller 44 on the carriage 46 and rail assembly 48 via the festoon actuator 50. The festoon actuator 50 may comprise a pneumatic cylinder that includes a position sensor 52 and a pressure sensor 54 which provide inputs to a control as discussed in greater detail below. A festoon assembly may be provided for each unwind (load station assembly, pivot arm assembly) of the unwind machine 12. Instead of a festoon assembly, the operator may manually cause the upper pivot arm assembly to accumulate a length of web. The operator may also manually rotate the new roll in the load station assembly to reduce starting inertia of the new roll as it begins to unwind from the load station assembly.

The unwind machine 12 may include a splice box assembly 60 that is configured to join the web material from an expiring roll with web material of a new roll with a splice nip bar actuator 63 and thereafter separate the web material from the expiring roll from the web material of the new roll with an expiring web cutoff actuator 64. Generally speaking, after the new roll in loaded in the load station assembly 22, the operator will thread the web from the new roll to the splice box assembly where double sided tape is applied to the leading edge of the web from the new roll so that after the splice of the web is made from the expiring roll the web from the new roll may continue to be paid out from the unwind machine. A splice box assembly may be provided for each unwind (load station assembly, pivot arm assembly) of the unwind machine 12. In the alternative to double sided tape, the splice may be made by ultrasonic bonding or by mechanical bonding through a nip formed by knurled wheels and an anvil roll. As an alternative to cutting off the expiring web, the expiring roll may be allowed to completely run out of web.

To assist in controlling the motion of the roll R as it is unwound from the load station assembly 22, a lower brake assembly 70 is provided. The lower brake assembly 70 is operatively coupled to the stand 20, and includes a lower brake arm 72, a lower brake arm actuator 74, and a rail assembly 76 extending outward from the stand. The lower brake arm 72 is operatively connected to the lower brake arm actuator 74 and operatively slidingly connected to the rail assembly 76. The lower brake arm actuator 74 has a stationary end operatively mounted to the stand 20 and an actuation end operatively connected to the lower brake arm 72. The lower brake arm actuator 74 is configured to move the lower brake arm 72 away from the stand 20 and toward the load station assembly 22 on the rail assembly 76 and to move the lower brake arm 72 into and out of engagement with the roll R when the roll is received in the load station assembly 22 during the first portion of the wind cycle. The lower brake arm actuator 74 may comprise a pneumatic cylinder that includes a position sensor 78 and a pressure sensor 80 which provide inputs to the control as discussed in greater detail below.

To assist in controlling the motion of the roll R as it is unwound from the pivot arm assembly 30, an upper brake assembly 90 is provided. The upper brake assembly 90 is operatively coupled to the pivot arm assembly 30 and includes an upper brake arm 92 and an upper brake arm actuator 94. The upper brake arm 92 is operatively pivotally connected to the upper brake arm actuator 94. The upper brake arm actuator 94 has a stationary end operatively connected to the pivot arm assembly 30 and an actuation end operatively connected to the upper brake arm 92. The upper brake arm actuator 94 and upper brake arm 92 move with the pivot arm assembly 30 as the pivot arm assembly moves between the raised and the lowered positions 34,36. The upper brake arm actuator 94 is configured to move the upper brake arm 92 into and out of engagement with the roll R when the roll is received in the pivot arm assembly 30. Depending upon the stage of the unwind cycle, the upper brake arm actuator 94 is also configured to move the upper brake arm 92 into and out of engagement with the roll R when the roll is received in the load station assembly 22, for instance, prior to the pivot arm assembly receiving the roll from the load station assembly. The upper brake arm actuator 94 may comprise a pneumatic cylinder that includes a position sensor 96 and a pressure sensor 98 which provide inputs to the control as discussed in greater detail below.

To more fully automate functions and operations on the converting line, a control 100 with a human machine interface (HMI) 102 may be provided. The control 100 may also receive a signal from a Roll Prep pushbutton 111 located at the end of load station assembly 22. The control 100 may also receive a signal from a Splice Prep pushbutton 112 located near the splice box assembly 60. The control 100 may include a controller 104 with a processor 106 and memory 108. The control 100 may include a plurality of sensors throughout the converting line to allow monitoring and control of the converting line. In one aspect, the lower brake arm actuator 74 comprises pneumatic cylinder that includes a position sensor 78 and a pressure sensor 80, which enables the control to develop position and pressure signals for the lower brake arm actuator to move the lower brake arm 72. Signals corresponding to a pressure set point and corresponding feedback may be generated by a pressure transducer 80 for both the rod and the cap end of the cylinder of the lower brake arm actuator 74. Signals corresponding to a position set point and corresponding feedback may be generated by a position transducer 78 on the cylinder of the lower brake arm actuator 74. The signals generated by the position transducer 78 together with pressure transducer 80 can be provided to the control 100 to control the pressure exerted by the lower brake arm actuator 74 on the lower brake arm 72 and thus on the roll R, and to control the position of the lower brake arm 72 for the same purpose. In one aspect, with the roll R rotatably supported in the load station 22 assembly during the first portion of the unwind cycle, the control 100 is adapted and configured to receive the signal of the position sensor 78 and the signal of the pressure sensor 80 from the lower brake arm actuator 74 and based upon the lower brake arm actuator position sensor and pressure sensor, the control may be configured to generate signals for the lower brake arm actuator to position the lower brake arm 72 relative to the load station assembly 22 and the stand 20 to engage the roll R with the lower brake arm; determine a diameter measurement corresponding to the roll when the lower brake arm is engaged with the roll of web material; and generate signals for the lower brake arm actuator to control a level of force exerted by the lower brake arm actuator on the lower brake arm and against the roll when the lower brake arm is engaged with the roll. This functionality may be useful for control during the first portion of the wind cycle when the roll is in the load station assembly 22 in the first diameter configuration 24 and the second diameter configuration 26.

In another aspect of the control 100, the upper brake arm actuator 94 comprises a pneumatic cylinder that includes a position sensor 96 and a pressure sensor 98, which enables the control to develop position and pressure signals for the upper brake arm actuator to move the upper brake arm 92. Signals corresponding to a pressure set point and corresponding feedback may be generated by a pressure transducer 98 for both the rod and the cap end of the cylinder of the upper brake arm actuator 94. Signals corresponding to a position set point and corresponding feedback may be generated by a position transducer 96 on the cylinder of the upper brake arm actuator 94. The signals generated by the position transducer 96 together with pressure transducer 98 can be provided to the control to control the pressure exerted by the upper brake arm actuator 94 on the upper brake arm 92 and thus on the roll, and to control the position of the upper brake arm 92 for the same purpose. In one aspect, with the roll rotatably supported by the pivot arm assembly 30 during the second portion of the unwind cycle, the control 100 is adapted and configured to receive the signal of the position sensor 96 and the signal of the pressure sensor 98 from the upper brake arm actuator 94, and based upon the upper brake arm actuator position sensor and pressure sensor signals, the control may be configured to generate signals for the upper brake arm actuator 94 to position the upper brake arm 92 relative to the pivot arm assembly to engage the roll R of the web of material; determine a diameter measurement corresponding to the roll when the upper brake arm is engaged with the roll; and generate signals for the upper brake arm actuator to control a level of force exerted by the upper brake arm actuator on the upper brake arm and against the roll when the upper brake arm is engaged with the roll. This functionality may be useful for control during the second portion of the wind cycle when the roll is in the pivot arm assembly as shown by the raised position 36 in FIG. 2.

In another aspect of the control 100, the control may include a load sensor 110 downstream of the unwind machine 12. The load sensor 110 may be adapted and configured to sense a tension in the web downstream of the unwind machine 12 and generate a signal corresponding thereto for the control. The signal generated by the load sensor 110 may be processed by the controller to control tension of the web. The control may solely use the signal of the load sensor 110 to control tension in the web or may use the load sensor signal with other control signals to control tension in the web. The signals from the load sensor 110 may be fed back to trim the control signals for either one or both of the upper and lower brake arm actuators 74,94 and or the festoon actuator 50 for tension control by means of a proportional and integral (PI) loop control.

In another aspect of the control 100, the control is adapted to receive the load sensor signal, compare the load sensor signal to a desired tension level of the web; and then depending upon the stage of the wind cycle, the control can generate signals for the respective upper brake arm actuator 94 and/or lower brake arm actuator 74 to control tension in the web in a desired range. For instance, when the is roll rotatably supported in the load station assembly 22 during the first portion of the unwind cycle, the control may be adapted to generate control signals for the lower brake arm actuator 74 to control a level of force exerted by the lower brake arm actuator on the lower brake arm and against the roll in a manner so as to maintain a tension in the web being unwound from the unwind machine in a desired operating range; and when the roll is rotatably supported by the pivot arm assembly 30 during the second portion of the unwind cycle, the control may be adapted to generate signals for the upper brake arm actuator to control a level of force exerted by the upper brake arm actuator on the upper brake arm and against the roll in a manner so as to maintain a tension in the web being unwound from the unwind machine in a desired operating range. The signals of the load sensor 110 may also be used in one or both stages to provide feedback to the control in controlling the respective upper and/or lower brake arm actuator.

In another aspect of the control, signals from the upper and lower brake arm actuators 74,94 may be used for diameter determinations, web caliper determinations, and the length of web unwound from the roll. For instance, with the roll rotatably supported in the load station assembly during the first portion of the wind cycle, the control may be enabled to: determine the diameter measurement of the roll based upon the lower brake arm actuator position sensor 78 and pressure sensor 80; generate signals for the pivot arm actuator 32 to lower the pivot arm assembly 30 when the diameter measurement of the roll R reaches a desired set point; and generate signals for the upper brake arm actuator 94 to position the upper brake arm 92 relative to the pivot arm assembly 30 to engage the roll in the load station assembly with a nominal level of force.

In another aspect of the control, the control may be enabled to: determine the diameter measurement corresponding to the roll based upon the upper brake arm actuator position sensor 96 and pressure sensor 98; generate signals for the festoon actuator 50 to move the at least one moveable roller 42 in a manner to accumulate a length of the web material in the festoon assembly 40 when the diameter measurement of the roll rotatably supported in the pivot arm assembly 30 reaches a pre-splice threshold. The load sensor signal may provide feedback to the control for controlling the upper brake arm actuator 94 and the festoon actuator 50 to maintain tension in a desired range.

In another aspect of the control 100, the control may automatically sequence movements within the unwind machine during the first and second portions of the wind cycle. For example, with the roll rotatably supported in the load station assembly 22 during the first portion of the wind cycle and the pivot arm assembly 30 in the lowered position, the control may be enabled to: generate signals for the pivot arm actuator 32 to move the pivot arm assembly from the lowered position 34 to the raised position 36; generate signals for the upper brake arm actuator 94 to control the level of force exerted by the upper brake actuator on the upper brake arm 92; generate signals for the upper brake arm actuator 94 to control a position of the upper brake arm relative to the pivot arm assembly 30; determine the diameter measurement corresponding to the roll based upon the upper brake arm actuator position sensor 96 and pressure sensor 98; and generate signals for the lower brake arm 70 actuator to move the lower brake arm 72 out of engagement with the roll and toward the stand 20.

In another aspect, with the roll rotatably supported in the pivot arm assembly 30 with the pivot arm assembly in the raised position 36 during the second portion of the unwind cycle, and with a new roll of web material rotatably supported in the load station assembly and in queue for splicing with the web material from the expiring roll, the control 100 is enabled to: generate signals for the lower brake arm actuator 70 to position the lower brake arm 72 relative to the load station assembly 22 and the stand 20 to engage the further roll with the lower brake arm; determine a diameter measurement corresponding to the further roll when the lower brake arm 72 is engaged with the further roll based upon the lower brake arm actuator position sensor 78 and pressure sensor 80; and generate signals for the lower brake arm actuator 74 to control a level of force exerted by the lower brake arm actuator 74 on the lower brake arm 72 and against the further roll when the lower brake arm 72 is engaged with the further roll based upon the lower brake arm actuator position sensor 78 and pressure sensor 80.

In another aspect, the control 100 may be enabled to automatically sequence splice events. For instance, when the control determines that the diameter measurement reaches a splice threshold, the control is enabled to: generate signals for the upper brake arm actuator 94 to control the level of force exerted by the upper brake arm actuator on the upper brake arm 92 so that the upper brake arm engages the roll of the web of material with sufficient force to prevent rotation of the roll in the pivot arm assembly.

As another example, the control may further comprise a splice sensor 62 arranged in the splice box assembly 60 that is adapted and configured to sense the web material from the expiring roll being spliced and joined with the web material of the new roll. The splice sensor 62 may generate respective signals corresponding to the splicing and joining of the rolls. Based upon the splice sensor signal indicating that the web material from the roll is spliced and joined with the web material of the new roll, and based at least in part upon the load sensor signal, the control may be enabled to: generate signals for the festoon actuator 50 to control the level of force exerted by festoon actuator on the at least one movable roller 42 in a manner so as to maintain a tension in the web being dispensed from the festoon assembly 40 in a desired operating range.

As an alternative to the splice sensor 62, the control 100 may determine from the actuation of the splice nip bar actuator 63 and thereafter the actuation of the expiring web cutoff actuator 64 that the web material from the expiring roll has been spliced and joined with the web material of the new roll. This determination by the control that the web material from the roll is spliced and joined with the web material of the new roll, and based at least in part upon the load sensor signal, the control may be enabled to: generate signals for the festoon actuator 50 to control the level of force exerted by festoon actuator on the at least one movable roller 42 in a manner so as to maintain a tension in the web being dispensed from the festoon assembly 40 in a desired operating range.

As a further example, with the new roll rotatably supported in the load station assembly during a first portion of the wind cycle of the new roll, the control 100 may be enabled to: generate the signals for the lower brake arm actuator 74 to control a level of force exerted by the lower brake arm actuator on the lower brake arm 72 and against the new roll when the lower brake arm engages the new roll, and for the festoon actuator 50 to control the level of force exerted by festoon actuator 50 on the at least one movable roller 42 in a manner so as to maintain a tension in the web downstream of the unwind machine in a desired operating range. The load sensor 110 signal may provide feedback to the control for controlling the lower brake arm actuator 74 and the festoon actuator 50 to maintain tension in a desired range. Accordingly, the controller 104 of the control may execute commands such that tension control may be transitioned in a ramped fashion from the festoon actuator 50 to the lower brake arm actuator 74. By enabling the controller 104 to execute commands such that tension control is transitioned in a ramped fashion from the festoon actuator 50 to the lower brake arm actuator 74, transients of web tension may be reduced/eliminated as the new roll is unwound from the load station assembly in the first portion of the wind cycle of the new roll.

In another aspect, the control 100 may process operator completed tasks so as to further enable the automatic sequencing of operations of the converting line. For instance, after a splice event, the operator may remove the expired roll from the pivot arm assembly and provide an input to the control via the HMI 102 indicating completion. This may enable the control to execute commands to start the process of lowering the pivot arm assembly 30 when the new roll reaches the desired diameter for a new cycle. As another example, the operator may provide an input to the control 100 via the HMI 102 or a Roll Prep pushbutton 111 located at the end of load station assembly 22 indicating that a new roll is loaded in the load station assembly 22 and is ready for splicing with an expired roll. As another example, the operator may provide input to the control 100 via the HMI 102 or a Roll Prep pushbutton 111 located at the end of load station assembly 22 that the new roll has been threaded to the splice box assembly 60 and has been taped.

In one aspect of the control, the actuator of any one or more of the lower brake assembly, the upper brake assembly and the actuator of festoon assembly may be a pneumatic cylinder. Also, the actuator of the lower brake assembly, the upper brake assembly, and the festoon assembly may all be identical pneumatic cylinders with identical pressure and position transducers to streamline efficiency in integration of the control. The control may be utilized in new line constructions or retrofitted to existing line configurations.

In another aspect, a method includes: loading a roll of web material in a load station assembly 22 of the unwind machine 12 wherein the unwind machine has the stand 20 for supporting components of the unwind machine and the load station assembly 22 is operatively coupled to the stand. The method further includes rotatably supporting the roll in the load station assembly 22 as the web material is unwound from the unwind machine during a first portion of the unwind cycle. The method further includes operating a lower brake assembly 70 operatively coupled to the stand by actuating a lower brake arm actuator 74 to move a lower brake arm 72 operatively slidingly connected to a rail assembly 76. The lower brake arm 72 is moved on the rail assembly 76 from a position where the lower brake arm 72 is toward the stand and out of engagement with the roll to a position away from the stand 20 and into engagement with the roll in the load station assembly. The method includes: determining a position of the lower brake arm 72 with a lower brake arm actuator position sensor 78; determining a force applied by the lower brake arm actuator 74 on the lower brake arm 72 and against the roll with a lower brake arm actuator pressure sensor 80; operating a pivot arm assembly 30 operatively coupled to the stand 22 by actuating a pivot arm actuator 32 operatively connected to the pivot arm assembly to move the pivot arm assembly from a raised position 36 away from the load station assembly 22 to a lowered position 34 adjacent the load station assembly; receiving the roll from the load station assembly 22 to the pivot arm assembly 30 in the lowered position; rotatably supporting the roll with the pivot arm assembly 30 as the pivot arm assembly moves the roll between the lowered position 34 and the raised position 36 as the web material is unwound from the unwind machine during a second portion of the unwind cycle; operating an upper brake assembly 90 operatively coupled to the pivot arm assembly by actuating a upper brake arm actuator 94 to move an upper brake arm 92 operatively pivotally connected to the upper brake arm actuator 94 from a position out of engagement with the roll to a position in engagement with the roll; determining a position of the upper brake arm 92 with an upper brake arm actuator position sensor 96; determining a force applied by the upper brake arm actuator 94 on the upper brake arm 92 and against the roll with a upper brake arm actuator pressure sensor 98 when the upper brake arm is engaged with the roll; and actuating the lower brake arm actuator 74 to move the lower brake arm 72 from the position where the lower brake arm is away from the stand and in engagement with the roll to a position where the lower brake arm is toward the stand and out of engagement with the roll in the load station assembly 22.

In another aspect, the method includes determining a diameter measurement corresponding to the roll when the lower brake arm 72 is engaged with the roll of web material. In another aspect the method includes determining a diameter measurement corresponding to the roll when the upper brake arm 92 is engaged with the roll of web material.

In another aspect, the method includes sensing a tension in the web downstream of the unwind machine with a load sensor 110 downstream of the unwind machine 12 and comparing the load sensor signal to a desired tension level of the web. So, when the roll is rotatably supported in the load station assembly 22 during the first portion of the unwind cycle, the method includes actuating the lower brake arm actuator 74 to control a level of force exerted by the lower brake arm actuator on the lower brake arm and against the roll in a manner so as to maintain a tension in the web being unwound from the unwind machine in a desired operating range; and when the roll is rotatably supported by the pivot arm assembly during the second portion of the unwind cycle, the method includes actuating the upper brake arm actuator 94 to control a level of force exerted by the upper brake arm actuator on the upper brake arm 92 and against the roll in a manner so as to maintain a tension in the web being unwound from the unwind machine in a desired operating range.

In another aspect of the method, with the roll rotatably supported in the load station assembly 22 during the first portion of the wind cycle, the method includes: determining the diameter measurement of the roll based upon the lower brake arm actuator position sensor 78 and pressure sensor 80; actuating the pivot arm actuator 32 to lower the pivot arm assembly 30 when the diameter measurement reaches a desired set point; and actuating the upper brake arm actuator 94 to position the upper brake arm 92 relative to the upper brake arm to engage the roll in the load station assembly 22 with a nominal level of force.

In another aspect of the method, with the roll rotatably supported in the load station assembly 22 during the first portion of the wind cycle and the pivot arm assembly 30 in the lowered position 34, the method includes: actuating the pivot arm actuator 32 to move the pivot arm assembly 30 from the lowered position 34 to the raised position 36; actuating the upper brake arm actuator 94 to control the level of force exerted by the upper brake actuator on the upper brake arm 92; actuating the upper brake arm actuator 94 to control a position of the upper brake arm 92 relative to the pivot arm assembly 30 determining the diameter measurement corresponding to the roll R based upon the upper brake arm actuator position sensor 96 and the pressure sensor 98; and actuating the lower brake arm actuator 74 to move the lower brake arm 72 out of engagement with the roll and toward the stand.

In another aspect of the method, with the roll rotatably supported in the pivot arm assembly 30 with the pivot arm assembly 30 in the raised position 36 during the second portion of the unwind cycle, and with a new roll of web material rotatably supported in the load station assembly 22 and in queue for splicing with the web material from the expiring roll, the method includes: actuating the lower brake arm actuator 74 to position the lower brake arm 72 relative to the load station assembly 22 and the stand 20 to engage the new roll with the lower brake arm 72; determining a diameter measurement corresponding to the new roll when the lower brake arm 72 is engaged with the new roll based upon the lower brake arm actuator position sensor 78 and pressure sensor 80; and actuating the lower brake arm actuator 74 to control a level of force exerted by the lower brake arm actuator 74 on the lower brake arm 72 and against the new roll when the lower brake arm 72 is engaged with the new roll based upon the lower brake arm actuator position sensor 78 and pressure sensor 80.

In another aspect, the method includes: determining the diameter measurement corresponding to the roll based upon the upper brake arm actuator position sensor 96 and pressure sensor 98; and actuating the festoon actuator 50 to move at least one moveable roller 42 of the festoon assembly 40 relative to at least one fixed roller 44 of the festoon assembly on a rail assembly 46 of the festoon assembly in a manner to accumulate a length of the web material in the festoon assembly when the diameter measurement of the roll rotatably supported in the pivot arm assembly 30 reaches a pre-splice threshold.

In another aspect, the method includes: actuating the upper brake arm actuator 94 to control the level of force exerted by the upper brake arm actuator 94 on the upper brake arm 92 so that the upper brake arm 92 engages the roll of the web of material with sufficient force to prevent rotation of the roll in the pivot arm assembly when the control 100 determines that the diameter measurement reaches a splice threshold and a splice to a new roll has been completed.

In another aspect, the method includes: providing a splice sensor 62 arranged in a splice box assembly 60 configured to splice and join the web material from the roll with web material of a new roll; and based upon the splice sensor signal indicating that the web material from the roll is spliced and joined with the web material of the new roll, and based at least in part upon the load sensor signal, the method includes actuating the festoon actuator 50 to control the level of force exerted by festoon actuator 50 on the at least one movable roller 42 in a manner so as to maintain a tension in the web being dispensed from the festoon assembly 40 in a desired operating range.

In another aspect of the method, with the new roll rotatably supported in the load station assembly 22 during a first portion of the wind cycle of the new roll, the method includes actuating the lower brake arm actuator 74 to control a level of force exerted by the lower brake arm actuator on the lower brake arm 72 and against the new roll when the lower brake arm 72 engages the new roll; and actuating the festoon actuator 50 to control the level of force exerted by festoon actuator 50 on the at least one movable roller 42 in a manner so as to maintain a tension in the web downstream of the unwind machine in a desired operating range.

Further embodiments can be envisioned by one of ordinary skill in the art after reading this disclosure. In other embodiments, combinations or sub-combinations of the above-disclosed invention can be advantageously made. The example arrangements of components are shown for purposes of illustration and it should be understood that combinations, additions, re-arrangements, and the like are contemplated in alternative embodiments of the present invention. Thus, various modifications and changes may be made thereunto without departing from the broader spirit and scope of the invention as set forth in the claims and that the invention is intended to cover all modifications and equivalents within the scope of the following claims.

What is claimed is:

1. A converting line comprising:

a control for the converting line, the control including a controller having a processor and a memory, the control including a load sensor downstream of an unwind machine, the load sensor being adapted and configured to sense a tension in the web downstream of the unwind machine and generate signal corresponding thereto;

the unwind machine adapted and configured to deliver a web of material to downstream equipment in the converting line, the unwind machine comprising:

a stand for supporting components of the unwind machine;

a load station assembly operatively coupled to the stand, the load station assembly being adapted and configured to receive a roll of the web material, the load station assembly being configured to rotatably support the roll as the web material is unwound from the unwind machine during a first portion of the unwind cycle;

a vertical movement assembly operatively coupled to the stand, the vertical movement assembly adapted and configured to receive the roll from the load station assembly, the vertical movement assembly including a vertical movement actuator, the vertical movement actuator being configured to move the vertical movement assembly between a lowered position adjacent the load station assembly and a raised position away from the load station assembly, the vertical movement assembly being configured to rotatably support the roll as the vertical movement assembly moves the roll between the lowered position and the raised position as the web material is unwound from the unwind machine during a second portion of the unwind cycle;

a lower brake assembly operatively coupled to the stand, the lower brake assembly being adapted and configured to control rotation of the roll in the load station assembly during the first portion of the unwind cycle;

an upper brake assembly operatively coupled to the vertical movement assembly, the upper brake assembly being adapted and configured to control rotation of the roll with the roll in the vertical movement assembly during the second portion of the wind cycle;

wherein with the roll rotatably supported in the load station assembly during the first portion of the unwind cycle, the control is adapted and configured to generate signals for the lower brake assembly to control a rate of rotation of the roll in the load station assembly;

wherein with the roll rotatably supported by the vertical movement assembly during the second portion of the unwind cycle, the control is adapted and configured to generate signals for the upper brake assembly to control a rate of rotation of the roll in the vertical movement assembly;

and a splice box assembly, the splice box assembly being configured to splice and join the web material from the roll with web material of a further roll.

2. The converting line of claim 1 wherein:

the lower brake assembly includes a lower brake arm, a lower brake arm actuator, and a rail assembly extending outward from the stand, the lower brake arm being operatively connected to the lower brake arm actuator and being operatively slidingly connected to the rail assembly, the lower brake arm actuator being configured to move the lower brake arm away from and toward the stand on the rail assembly and move the lower brake arm into and out of engagement with the roll when the roll is received in the load station assembly during the first portion of the wind cycle, the lower brake arm actuator including a position sensor and a pressure sensor; and wherein with the roll rotatably supported in the load station assembly during the first portion of the unwind cycle, the control is adapted and configured to receive the position sensor signal and the pressure sensor signal from the lower brake arm actuator and based upon the lower brake arm actuator position sensor and pressure sensor:

generate signals for the lower brake arm actuator to position the lower brake arm relative to the load station assembly and the stand to engage the roll with the lower brake arm;

determine a diameter measurement corresponding to the roll when the lower brake arm is engaged with the roll of web material; and generate signals for the lower brake arm actuator to control a level of force exerted by the lower brake arm actuator on the lower brake arm and against the roll when the lower brake arm is engaged with the roll.

3. The converting line of claim 1 wherein:

the upper brake assembly includes an upper brake arm and an upper brake arm actuator, the upper brake arm being operatively pivotally connected to the upper brake arm actuator, the upper brake arm actuator being operatively connected to the vertical movement assembly and moving with the vertical movement assembly between the raised and the lowered positions of the vertical movement assembly, the upper brake arm actuator being configured to move the upper brake arm into and out of engagement with the roll when the roll is received in the vertical movement assembly, the upper brake arm actuator including a position sensor and a pressure sensor;

wherein with the roll rotatably supported by the vertical movement assembly during the second portion of the unwind cycle, the control is adapted and configured to receive the position sensor signal and the pressure sensor signal from the upper brake arm actuator, and based upon the upper brake arm actuator position sensor and pressure sensor:

generate signals for the upper brake arm actuator to position the upper brake arm relative to the vertical movement assembly to engage the roll of the web of material;

determine a diameter measurement corresponding to the roll when the upper brake arm is engaged with the roll; and generate signals for the upper brake arm actuator to control a level of force exerted by the upper brake arm actuator on the upper brake arm and against the roll when the upper brake arm is engaged with the roll.

4. The converting line of claim 1 wherein:

the control is adapted to:

receive the load sensor signal;

compare the load sensor signal to a desired tension level of the web; and when the is roll rotatably supported in the load station assembly during the first portion of the unwind cycle, the control is adapted to:

generate control signals for the lower brake assembly to control the rate of rotation of the roll in the load station in a manner so as to maintain a tension in the web being unwound from the unwind machine in a desired operating range; and when the roll is rotatably supported by the vertical movement assembly during the second portion of the unwind cycle, the control is adapted to:

generate signals for the upper brake arm assembly to control the rate of rotation of the roll in a manner so as to maintain a tension in the web being unwound from the unwind machine in a desired operating range.

5. The converting line of claim 1 wherein:

with the roll rotatably supported in the load station assembly during the first portion of the wind cycle, the control is enabled to:

determine the diameter measurement of the roll; and generate signals for the vertical movement actuator to lower the vertical movement assembly when the diameter measurement reaches a desired set point.

6. The converting line of claim 5 wherein:

with the roll rotatably supported in the load station assembly during the first portion of the wind cycle and the vertical movement assembly in the lowered position, the control is enabled to:

generate signals for the vertical movement actuator to move the vertical movement assembly from the lowered position to the raised position; and generate signals for the upper brake assembly to control the rate of rotation of the roll in the vertical movement assembly so as to maintain a tension of the web in a desired operating range.

7. The converting line of claim 6 wherein:

with the roll rotatably supported in the vertical movement assembly with the vertical movement assembly in the raised position during the second portion of the unwind cycle, and with a further roll of web material rotatably supported in the load station assembly and in queue for splicing with the web material from the roll, the control is enabled to generate signals for the lower brake assembly to control the rotation of the further roll in the load station assembly.

8. The converting line of claim 7 wherein:

with the roll rotatably supported in the vertical movement assembly with the vertical movement assembly in the raised position during the second portion of the unwind cycle, and with a further roll of web material rotatably supported in the load station assembly and in queue for splicing with the web material from the roll, the control is enabled to determine a diameter measurement corresponding to the further roll.

9. The converting line of claim 6 further comprising:

a festoon assembly downstream of the unwind machine, the festoon assembly comprising at least one moveable roller and at least one fixed roller, the at least one moveable roller being operatively connected to a festoon actuator and operatively slidingly connected to a rail assembly of the festoon assembly, the at least one moveable roller being adapted and configured to move toward and away from the at least one fixed roller on the rail assembly via the festoon actuator; and wherein:

the control being enabled to:

determine the diameter measurement corresponding to the roll;

generate signals for the festoon actuator to move the at least one moveable roller in a manner to accumulate a length of the web material in the festoon assembly when the diameter measurement of the roll rotatably supported in the vertical movement assembly reaches a pre-splice threshold.

10. The converting line of claim 9 wherein:

when the control determines that the diameter measurement reaches a splice threshold, the control is enabled to generate signals for the upper brake assembly to prevent rotation of the roll in the vertical movement assembly.

11. The converting line of claim 10 wherein:

the control further comprises a splice sensor arranged in the splice box assembly, the splice sensor being adapted and configured to sense the web material from the roll being spliced and joined with the web material of the further roll, and generate respective signals corresponding thereto.

12. The converting line of claim 11 wherein:

based upon the splice sensor signal indicating that the web material from the roll is spliced and joined with the web material of the further roll, and based at least in part upon the load sensor signal, the control is enabled to:

generate signals for the festoon actuator to control the level of force exerted by festoon actuator on the at least one movable roller in a manner so as to maintain a tension in the web being dispensed from the festoon assembly in a desired operating range.

13. The converting line of claim 12 wherein:

with the further roll rotatably supported in the load station assembly during a first portion of the wind cycle of the further roll, the control is enabled to:

generate the signals for the lower brake assembly to control a rate of rotation of the further roll, and generate signals for the festoon actuator to control the level of force exerted by festoon actuator on the at least one movable roller in a manner, wherein the signals for the lower brake assembly and festoon actuator are generated so as to maintain a tension in the web downstream of the unwind machine in a desired operating range.

14. The converting line of claim 1 wherein the vertical movement assembly is configured for one of pivoting motion, vertical linear motion and vertical compound motion.

15. A method of controlling a converting line, the method comprising:

loading a roll of web material in a load station assembly of a unwind machine wherein the unwind machine has a stand for supporting components of the unwind machine and the load station assembly is operatively coupled to the stand;

rotatably supporting the roll in the load station assembly as the web material is unwound from the unwind machine during a first portion of the unwind cycle;

operating a lower brake assembly operatively coupled to the stand to control rotation of the roll in the load station assembly;

operating a vertical movement assembly operatively coupled to the stand by actuating a vertical movement actuator operatively connected to the vertical movement assembly to move the vertical movement assembly from a raised position away from the load station assembly to a lowered position adjacent the load station assembly and;

receiving the roll from the load station assembly with the vertical movement assembly in the lowered position;

rotatably supporting the roll with the vertical movement assembly as the vertical movement assembly moves with the roll between the lowered position and the raised position as the web material is unwound from the unwind machine during a second portion of the unwind cycle; and operating an upper brake assembly to control a rate of rotation of the roll.

16. The method of claim 15 further comprising:

determining a diameter measurement corresponding to the roll in the load station assembly.

17. The method of claim 15 further comprising:

determining a diameter measurement corresponding to the roll in the vertical movement assembly.

18. The method of claim 15 further comprising:

with a load sensor downstream of the unwind machine, sensing a tension in the web downstream of the unwind machine, comparing the load sensor signal to a desired tension level of the web; and when the is roll rotatably supported in the load station assembly during the first portion of the unwind cycle, actuating the lower brake assembly to control the rate of rotation of the roll in a manner so as to maintain a tension in the web being unwound from the unwind machine in a desired operating range; and when the roll is rotatably supported by the vertical movement assembly during the second portion of the unwind cycle, actuating the upper brake arm assembly to control the rate of rotation of the roll in a manner so as to maintain a tension in the web being unwound from the unwind machine in a desired operating range.

19. The method of claim 18 wherein:

with the roll rotatably supported in the load station assembly during the first portion of the wind cycle, the method further comprising:

determining the diameter measurement of the roll; and actuating the vertical movement actuator to lower the vertical movement assembly when the diameter measurement reaches a desired set point.

20. The method of claim 19 wherein:

with the roll rotatably supported in the load station assembly during the first portion of the wind cycle and the vertical movement assembly in the lowered position, the method further comprises:

actuating the vertical movement actuator to move the vertical movement assembly from the lowered position to the raised position;

actuating the upper brake assembly to control the rate of rotation of the roll in the vertical movement assembly;

determining the diameter measurement corresponding to the roll in the vertical movement assembly.

21. The method of claim 20 wherein:

with the roll rotatably supported in the vertical movement assembly with the vertical movement assembly in the raised position during the second portion of the unwind cycle, and with a further roll of web material rotatably supported in the load station assembly and in queue for splicing with the web material from the roll, the method further comprises actuating the lower brake assembly to control the rate of rotation of the further roll in the load station assembly.

22. The method of claim 21 further comprising:

determining a diameter measurement corresponding to the further roll in the load station assembly.

23. The method of claim 21 further comprising:

actuating an actuator on a festoon assembly downstream of the unwind machine to move at least one moveable roller of the festoon assembly relative to at least one fixed roller of the festoon assembly on a rail assembly of the festoon assembly in a manner to accumulate a length of the web material in the festoon assembly when the diameter measurement of the roll rotatably supported in the vertical movement assembly reaches a pre-splice threshold.

24. The method of claim 23 further comprising:

actuating the upper brake arm assembly to prevent rotation of the roll in the vertical movement assembly when the control determines that the diameter measurement reaches a splice threshold.

25. The method of claim 24 further comprising:

providing a splice sensor arranged in a splice box assembly configured to splice and join the web material from the roll with web material of a further roll; and based upon the splice sensor signal indicating that the web material from the roll is spliced and joined with the web material of the further roll, and based at least in part upon the load sensor signal, actuating the festoon actuator to control the level of force exerted by festoon actuator on the at least one movable roller in a manner so as to maintain a tension in the web being dispensed from the festoon assembly in a desired operating range.

26. The method of claim 25 wherein:

with the further roll rotatably supported in the load station assembly during a first portion of the wind cycle of the further roll, the method further comprising:

actuating the lower brake assembly to control the rate of rotation of the further roll in the load station assembly; and actuating the festoon actuator to control the level of force exerted by festoon actuator on the at least one movable roller in a manner so as to maintain a tension in the web downstream of the unwind machine in a desired operating range.

27. The method of claim 15 wherein rotatably supporting the roll with the vertical movement assembly and moving the vertical movement assembly between the lowered position and the raised positions includes moving the vertical movement assembly with one of pivoting motion, vertical linear motion and vertical compound motion.

* * * * *